US005387894A

United States Patent [19]

Allan et al.

[11] Patent Number: 5,387,894

[45] Date of Patent: Feb. 7, 1995

[54] DISTRIBUTION TRANSFORMERS

[75] Inventors: Dennis J. Allan; John V. Grant, both of Stafford, England

[73] Assignee: GEC Alsthom Limited, England

[21] Appl. No.: 896,198

[22] Filed: Jun. 10, 1992

[30] Foreign Application Priority Data

Jun. 10, 1991 [GB] United Kingdom ..... 9112435

[51] Int. Cl.[6] ..... H01F 27/25

[52] U.S. Cl. ..... 336/213; 336/220; 336/225

[58] Field of Search ..... 336/220, 221, 225, 213, 336/198, 208

[56] References Cited

U.S. PATENT DOCUMENTS

| | | | |
|---|---|---|---|
| 2,314,912 | 3/1943 | Troy . | |
| 2,359,173 | 9/1944 | Troy . | |
| 3,128,443 | 4/1964 | Herman et al. . | |
| 4,646,048 | 2/1987 | Hunt et al. | 336/213 |
| 4,651,412 | 3/1987 | Beisser | 29/605 |
| 4,906,960 | 3/1990 | Alexandrov | 336/60 |
| 5,168,225 | 12/1992 | Poulson | 336/5 |
| 5,202,664 | 4/1993 | Poulson | 336/5 |

*Primary Examiner*—Leo P. Picard
*Assistant Examiner*—L. Thomas
*Attorney, Agent, or Firm*—Kirschstein, Ottinger, Israel & Schiffmiller

[57] ABSTRACT

A distribution transformer has a wound magnetic core (50) of overall circular shape and rectangular cross-section with between two and four overall rectangular shape electric coils (20,30) extending through the core window. The coils (20,30) are pre-formed and assembled so that their parts (20A,30A) which meet form a circular section solid cylinder. A mandrel (40) is then located around this cylinder (20A,30A) and continuous non-amorphous steel strip is wound thereon to form an unannealed, uncut wound magnetic core of axial length in the range 250 mm to 1 m. In a modification, amorphous steel strip is first wound on to another mandrel, annealed, and then transferred from the other mandrel on to the mandrel around the coils.

10 Claims, 3 Drawing Sheets

DISTRIBUTION TRANSFORMERS

BACKGROUND OF THE INVENTION

1. Field of the Invention

This invention relates to electrical power distribution transformers. In particular the invention relates to methods of making such distribution transformers of the type which include a core and coil assembly having a wound magnetic core with a central window and one or more electric coils which extend through said core window, and to the transformers so made.

2. Description of the Related Art

Two known methods of making a transformer core and coil assembly of the above-defined type, and in which the core is of overall rectangular shape, will now be described.

In the first such known method the wound core is made by winding magnetic steel strip of single width into a circular roll, and in winding each turn it is cut at approximately the same point. The circular roll is then pressed into an overall rectangular shape core having distributed gaps through one side of the rectangle where the turns were cut, and it is then annealed to fix the rectangular shape. The cut core turns are then opened up and bent out to form a U-shape, a pre-formed rectangular cylindrical coil is assembled on each of the two legs of the U-shape, and the cut core turns are then closed to re-form the rectangular core shape and are jointed. However well the cuts are jointed they will add significantly to the power loss of the core. Also with this method, the machinery for cutting the magnetic steel strip involves significant cost. Futhermore the present and expected future trend is to use progressively thinner magnetic steel strip which has inherently lower power loss, but thinner strip is more difficult to handle in processes which involve cutting. Another disadvantage of this method is that the equipment and process involved in annealing the core contributes significantly to the cost of manufacturing the transformer.

In the second known method of making a rectangular shape wound core transformer, magnetic steel strip of varying width is wound continuously without cuts on to a rectangular mandrel to form an overall rectangular shape core with an approximately circular cross-section. The core is then annealed to fix the rectangular shape. Split mandrels are then fitted over two legs of the core and a circular cylindrical coil is wound on to each mandrel. This second method avoids the manufacturing and power loss disadvantages associated with cutting in the above-described first method. However there is still the cost disadvantage of annealing the core. There are two further disadvantages of this second method. Firstly the only approximately circular cross-section of the core within the circular coils gives a significant reduction in space factor and hence higher power loss. Secondly, for larger size coils there is an increased level of difficulty in winding the coils leading to a practical upper limit of approximately 50 KVA rated power for transformers made by this method, which does not cover the full rated power range required for distribution transformers.

Conventionally, rectangular shape wound transformer cores, whether cut or uncut, have been made with non-amorphous steel strip. More recently such transformer cores have become known which are made with amorphous steel strip. This material has much lower power loss than non-amorphous steel, but this advantage is partially offset by the higher intrinsic material cost. Also, amorphous steel has only been available with a strip width up to approximately 200 mm, 213 mm being the highest strip width of which we are aware, which limits the size of wound cores using a single strip width and hence the rated power of transformers using such cores so that they do not cover the full rated power range required for distribution transformers.

SUMMARY OF THE INVENTION

An object of the present invention is to provide an improved method of making a transformer having regard to the above-mentioned limitations and disadvantages associated with the above-described known rectangular wound core transformers.

According to the invention there is provided a method of making an electrical power distribution transformer which includes a core and coil assembly having a wound magnetic core with a central window and electric coils which extend through said core window, characterised in that the method includes the steps of (i) individually pre-forming each of a number of overall rectangular shape said electric coils in the range between two and four coils, each said coil being pre-formed by winding electrical conductors on a respective support which provides a groove having at least in part the shape of a sector of a circle so that said coil has a cross-section of that sector shape at least where it will pass through the core window, (ii) assembling the pre-formed coils together so that their circle sector cross-sectioned parts combine to form a circular section solid cylinder where they meet, (iii) locating a hollow circular cylindrical mandrel around said circular section solid cylinder, and (iv) rotating said mandrel to wind thereon a single roll or up to four stacked co-axial rolls each of continuous single or multiple thickness non-amorphous steel strip, the or each strip having a single width in the range 250 mm to 1 m and the total axial length of the roll or co-axial rolls being in the range 250 mm to 1 m, thereby to form an unannealed, uncut said wound magnetic core, having overall circular shape and rectangular cross-section, with said core window substantially filled by said coils.

By winding magnetic steel strip on to pre-formed coils to form a circular core, both the need to cut the strip and to anneal the core is avoided and the manufacturing cost is reduced compared with the above-described known methods of making rectangular core transformers. We consider that steel strips of width up to 1 m can be handled for winding without significant difficulty.

According to the invention there is further provided an electrical power distribution transformer which includes a core and coil assembly having a wound magnetic core with a central window and electric coils which extend through said core window, characterised in that the core is unannealed, is uncut, is of overall circular shape and rectangular cross-section, and consists of a single roll or up to four stacked co-axial rolls each wound of continuous single or multiple thickness non-amorphous steel strip, the or each strip having a single width in the range 250 mm to 1 m and the total axial length of the roll or co-axial rolls being in the range 250 mm to 1 m, and that there are a number of said electric coils in the range between two and four, each said coil being of overall rectangular shape, and each said coil having a cross-section which is a sector of a circle at least where said coils pass through the core window with the sector cross-sections together substantially filling the core window.

In this transformer the power loss associated with the cuts in the above-described known cut core transformer is avoided, and the poor space factor of the above-described known uncut core transformer is avoided.

We expect that the above-described distribution transformer according to the invention may have a power rating in the range 10 KVA to 2000 KVA. The upper end of this range, which we can achieve with a single roll core having a strip width of up to 1 m, is higher than can be provided with the above-described known uncut core transformers having the coils wound on to the pre-formed core, and is higher than can be provided with the above-described known transformers having a single strip of amorphous steel.

For a transformer core which is required to have a given cross-section area to carry the flux necessary to induce given required voltages in the coils, the mean path length of a circular wound core of non-amorphous steel in the core-coil configuration of a transformer according to the invention is substantially reduced down to possibly half the mean path length of a rectangular wound core of non-amorphous steel in the core-coil configuration of an equivalent power rated transformer as previously known. This accordingly by comparison reduces the volume and hence the weight of core steel. The cost of the steel used in the transformer and its power loss, which are both proportional to its weight, are therefore both reduced by comparison with such an equivalent previously known transformer.

Before making and testing a transformer in accordance with the invention as defined above we had expected that the high proportion of the coils outside the core in the circular core configuration specified, compared with that proportion in the previously known rectangular core configuration, would result in high flux leakage giving the transformer an unacceptably high reactance in the range of perhaps 20 to 60%. Surprisingly, we have found that reactance of transformers according to the invention is acceptably low in the region of 4%.

In a transformer or a method according to the invention as defined above, the low weight, low cost, low loss advantages over previously known rectangular wound core transformers may be enhanced by the non-amorphous steel strip being of a high permeability, low loss, type defined as having a power loss of less than 1.00 Watts/Kg at a magnetic induction of 1.7 Tesla at 50 HZ.

In a transformer or a method according to the invention as defined above, the high permeability, low loss, non-amorphous steel strip as just-described may have a thickness between 0.2 mm and 0.1 mm. Such a strip is too thin and possibly too brittle to be economically used to make cut transformer cores, but it can be more easily wound and so may be economically advantageously used in a transformer or a method according to the invention.

In IEEE Transactions on Power and Apparatus Systems, Vol.PAS-103, No.11, November 1984, pages 3365 to 3372 there is published a paper by E. L. Boyd and J. D. Borst entitled "Design concepts for an amorphous metal distribution transformer". In the summary at the end of this paper it is stated that "The unique characteristics of amorphous metals present significant challenges to the transformer designer and will likely result in a radically different core-coil assembly. This paper has defined a broad range of theoretical core-coil configurations and refined these to a feasible set of solutions through qualitative analysis of amorphous metal characteristics, transformer design requirements, and transformer assembly techniques." One of the feasible theoretical core-coil configurations discussed as worth future consideration for use with amorphous metal shows an overall circular shape uncut core with rectangular cross-section and two rectangular coils extending through the window of the core (configuration IIB in FIG. 3). On page 3367, left-hand column, it is stated that "The core-coil configuration may be significantly different from presently used conventional electrical steel configurations". There is thus no indication in this paper that configuration IIB may possibly be useful for wound core transformers using conventional (non-amorphous) steel in the manner as above-specified according to the present invention.

Considering the Boyd and Borst paper further, it is stated in relation to the uncut circular core, rectangular coil configuration IIB on page 3371, right-hand column, that "Because the cores are not annealed after forming, the no load loss—would be among the highest of the configuration possibilities". Indeed, it is known to anneal amorphous steel wound magnetic cores in a saturating magnetic field in order to induce alignment of the domain structure in the preferred magnetic direction around the transformer core, and this has been done prior to assembly of the coils on to the core. If amorphous steel is not annealed under magnetic induction, its inherent power loss is higher than that of conventional steel.

We consider that the above-mentioned problem posed by the Boyd and Borst paper in relation to annealing an uncut circular wound core of amorphous metal can be overcome; so that the low weight, low loss advantage of the circular wound core configuration compared with a rectangular core configuration for a transformer of the same rated power can be extended to the use of lower loss amorphous steel.

Accordingly, the present invention also provides a method of making an electrical power distribution transformer which includes a core and coil assembly having a wound magnetic core with a central window and electric coils which extend through said core window, characterised in that the method includes the steps of (i) individually pre-forming each of a number of overall rectangular shape said electric coils in the range between two and four coils, each said coil being pre-formed by winding electrical conductors on a respective support which provides a groove having at least in part the shape of a sector of a circle so that said coil has a cross-section of that sector shape at least where it will pass through the core window, (ii) assembling the pre-formed coils together so that their circle sector cross-sectioned parts combine to form a circular section solid cylinder where they meet, (iii) locating a hollow first circular cylindrical mandrel around said circular section solid cylinder, (iv) rotating at least one second circular cylindrical mandrel having the same external diameter as said first mandrel to wind thereon a roll of continuous single or multiple thickness single width amorphous steel strip, (v) annealing the or each said roll of amorphous steel strip under magnetic saturation, and (vi) rotating the first and second mandrels to transfer the annealed amorphous steel strip as a single roll or up to four stacked coaxial rolls on to the first mandrel to form thereon an uncut said wound magnetic core having overall circular shape and rectangular cross-section, with said core window substantially filled by said coils.

The invention also provides a transformer made by the just-described method.

Transferring the annealed amorphous steel strip between the two mandrels will stress the strip and introduce some power loss, but we believe this will be sufficienty small so that a worthwhile advantage is achieved in having amorphous steel in this uncut circular wound core configuration.

In a method according to the invention as defined above each said coil may be pre-formed by winding said electrical conductors on a respective said support comprising a former made up of sections, after which the former sections are separated for removal of the coil.

In a method according to the invention as defined above, respectively said mandrel or said first mandrel may be of electrically insulating material.

In a method or a transformer according to the invention as defined above, the steel strip forming the wound magnetic core is preferably of single thickness for ease of manufacture. Also in a method or a transformer according to the invention as defined above, the wound magnetic core will preferably consist of a single roll of steel strip for ease of manufacture.

Most conveniently in a method or a transformer according to the invention as defined above, two said electric coils extend through said core window in the transformer, each coil having a semi-circular cross-section where it passes through the core-window. One reason is that it may be desirable to impregnate the coils with resin to enable them to withstand short-circuit forces and this will be done for each coil before the coils are assembled together. The support structure of such an assembly will be more difficult to arrange if there are more than two resin impregnated coils. Another reason is that, in the case where the support on which each such coil is wound comprises sectioned former, then this former need only have two sections. If there are more than two coils, then for each coil the former will need to have more than two sections which will provide a groove having, for where the coil will pass through the core, the shape of a sector of a circle less than a semi-circle and will enable these sections to be removed from the coil after that coil has been wound.

In a method or a transformer according to the invention as defined above the transformer may be single phase with all the coils extending through only one core. If multi-phase transformation is required using a transformer in accordance with the invention it will be possible to provide a suitable number of discrete side-by-side single-phase transformer configurations. Alternatively, for a three-phase transformer, we consider it possible to provide a configuration according to the invention with three said overall circular, rectangular cross-section, wound cores and four said rectangular coils, with each core window having two of said coils passing through it and these two coils each having a semi-circular cross-section where they pass through this core window.

In all the methods and transformers according to the invention as above-defined, the electric coils are of overall rectangular shape. Coils of this shape may to some extent be liable to failure in service in short-circuit conditions if they are not mechanically strong enough at the outer rectangle corners to withstand the short-circuit forces which tend to force a coil into a circular shape. We consider that it may be possible to alleviate this problem by making these outer coil corners curved in an elliptical configuration as defined below.

Accordingly, the invention also provides a method of making an electrical power distribution transformer which includes a core and coil assembly having a wound magnetic core with a central window and electric coils which extend through said core window, characterised in that the method includes the steps of (i) individually pre-forming each of a number of overall semi-elliptical shape said electric coils in the range between two and four coils, each said coil being preformed by winding electrical conductors on a respective support which provides a groove having at least in part the shape of a sector of a circle so that said coil has a cross-section of that sector shape at least where it will pass through the core window, (ii) assembling the pre-formed coils together so that their circle sector cross-sectioned parts combine to form a circular section solid cylinder where they meet, (iii) locating a hollow circular cylindrical mandrel around said circular section solid cylinder, and (iv) rotating said mandrel successively to wind thereon at least two multiple turn rolls each of continuous single or multiple thickness single width non-amorphous steel strip, successive said rolls being coaxially wound one around another and being of decreasing strip width with the strip width of the radially inner roll not more than 1 m and the strip width of the radially outer roll not less than 250 mm, thereby to form an unannealed said wound magnetic core, having overall circular shape and ellipse segment cross-section, with said core window substantially filled by said coils.

Accordingly, the invention further provides an electrical power distribution transformer which includes a core and coil assembly having a wound magnetic core with a central window and electric coils which extend through said core window, characterised in that the core is unannealed, is of overall circular shape and ellipse segment cross-section, and consists of at least two multiple turn rolls each of single or multiple thickness single width non-amorphous steel strip, said rolls being coaxially wound one around another and being of decreasing strip width with the strip width of the radially inner roll not more than 1 m and the strip width of the radially outer roll not less than 250 mm, and that there are a number of said electric coils in the range between two and four, each said coil being of overall semi-elliptical shape, and each said coil having a cross-section which is a sector of a circle at least where said coils pass through the core window with the sector cross-sections together substantially filling the core window.

Accordingly, the invention also further provides a method of making an electrical power distribution transformer which includes a core and coil assembly having a wound magnetic core with a central window and electric coils which extend through said core window, characterised in that the method includes the step of:

(i) individually pre-forming each of a number of overall semi-elliptical shape said electric coils in the range between two and four coils, each said coil being preformed by winding electrical conductors on a respective support which provides a groove having at least in part the shape of a sector of a circle so that said coil has a cross-section of that sector shape at least where it will pass through the core window, (ii) assembling the pre-formed coils together so that their circle sector cross-sectioned parts combine to form a circular section solid cylinder where they meet, (iii) locating a hollow first circular cylindrical mandrel around said circular section solid cylinder, (iv) rotating a first further circular cylindrical mandrel having the same external diameter as said first mandrel to wind thereon a first roll of continuous single or multiple thickness single width amorphous steel strip, (v) rotating at least a second further circular cylindrical mandrel, successive further mandrels having the same external diameter as the previous roll of amorphous steel strip, to wind each on an individual mandrel at least a second roll of continuous single or multiple thickness single width amorphous steel strip, the successive rolls being of decreasing strip width, (vi) annealing the rolls of amorphous steel strip under magnetic saturation, and (vii) rotating the first mandrel and successively the further mandrels to transfer the annealed amorphous steel strip as rolls being coaxially wound one around another and of decreasing strip width on to the first mandrel to form thereon a said wound magnetic core having overall circular shape and ellipse segment cross-section, with said core window substantially filled by said coils.

With the elliptical core arrangements as defined above according to the invention, we consider that the power loss at the end cut of the successive rolls of steel strip will be negligible and that the continuous multiple turn rolls of different width will provide substantially the same advantages as the rectangular section cores previously defined according to the invention.

According to the invention in its various aspects so far defined above, the central window of the or each wound core has more than one coil extending therethrough. According to a modification of the invention there may be provided a single coil with more than one core wound around it.

Accordingly, the invention also provides a method of making an electrical power distribution transformer which includes a core and coil assembly having a wound magnetic core with a central window and an electric coil which extends through said core window, characterised in that the method includes the steps of (i) pre-forming a single coil having an overall rectangular shape and having at least two legs of circular cross-section, (ii) locating a hollow circular cylindrical mandrel around each of at least two said circular cross-section coil legs, and (iii) rotating each said mandrel to wind thereon a single roll or up to four stacked coaxial rolls each of continuous single or multiple thickness non-amorphous steel strip, the or each strip having a single width in the range 250 mm to 1 m and the total axial length of the roll or co-axial rolls on each mandrel being in the range 250 mm to 1 m, thereby to form an unannealed, uncut said wound magnetic core on each mandrel, having overall circular shape and rectangular cross-section, with the window of each said core substantially filled by said coil.

Accordingly, the invention further provides an electrical power distribution transformer which includes a core and coil assembly having a wound magnetic core with a central window and an electric coil which extends through said core window, characterised in that there is a single coil having an overall rectangular shape and having at least two legs of circular cross-section, and that at least two said circular cross-section coil legs each have thereon a core which is unannealed, is uncut, is of overall circular shape and rectangular cross-section, and consists of a single roll or up to four stacked co-axial rolls each wound of continuous single or multiple thickness non-amorphous steel strip, the or each strip having a single width in the range 250 mm to 1 m and the total axial length of the roll or co-axial rolls for each core being in the range 250 mm to 1 m, with the window of each said core being substantially filled by said coil.

Accordingly, the invention also further provides a method of making an electrical power distribution tranformer which includes a core and coil assembly having a wound magnetic core with a central window and an electric coil which extends through said core window, characterised in that the method includes the steps of:

(i) pre-forming a single coil having an overall rectangular shape and having at least two legs of circular cross-section, (ii) locating a hollow first circular cylindrical mandrel around each of a least two said circular cross-section coil legs, (iii) rotating at least one second circular cylindrical mandrel in respect of each first mandrel having the same external diameter as said respective first mandrel to wind thereon a roll of continuous single or multiple thickness single width amorphous steel strip, (iv) annealing each said roll of amorphous steel strip under magnetic saturation, and (v) rotating the first mandrels and the respective second mandrels to transfer the annealed amorphous steel strip as a single roll or up to four stacked coaxial rolls on to each of the first mandrels to form on each first mandrel an uncut said wound magnetic core having overall circular shape and rectangular cross-section, with the window of each said core substantially filled by said coil.

In the above-defined modification of the invention, there may conveniently be a wound core on each of two opposite legs of the single rectangular coil. An advantage in manufacture may be that it will be easier to wind each core around a leg of a single coil rather than within two or more coils. A further advantage may be that, compared with having a transformer with coils passing through a single core, these two cores through which the single coil passes may have a smaller radius in order to provide the total amount of flux carrying core required and hence the mean path length and resulting volume and weight of core steel is reduced.

Considering again the Boyd and Borst IEEE paper previously referred to in this specification, configuration IIIC in FIG. 3 of that paper shows a circular cross-section overall rectangular coil with two cores, one on each leg of the coil. In our opinion, this disclosure of configuration IIIC has the same relevance to the inventiveness of the modifications of our invention as just defined as that of the Boyd and Borst disclosure of configuration IIB does to our invention as first defined. There is no indication in the paper that configuration IIIC may possibly be used for wound core transformers using conventional (non-amorphous) steel in the manner as specified in the modifications of our invention, and furthermore in the modification of our invention as just specified above involving amorphous steel we have again solved the problem referred to by Boyd and Borst of annealing the formed cores.

BRIEF DESCRIPTION OF THE DRAWINGS

Examples of transformers and methods of making them in accordance with the invention will now be described with reference to the accompanying drawings, in which.

DETAILED DESCRIPTION OF THE PREFERRED EMBODIMENTS

Figure 1:
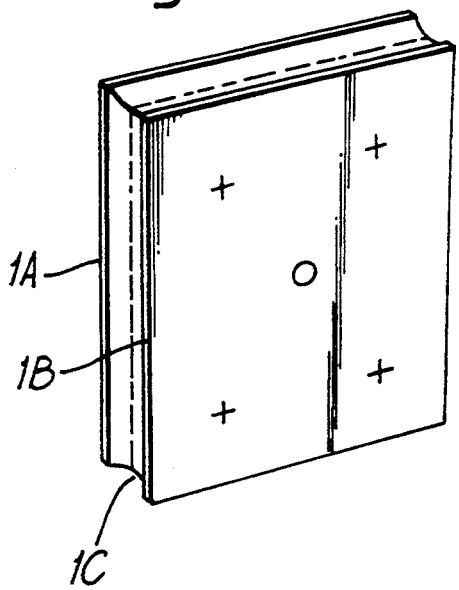
FIG. 1 shows a perspective view of a sectioned former on which a coil for a transformer is to be wound.

Referring now to the drawings, FIG. 1 shows a rectangular former made up of two sections 1A, 1B of-any suitable material with their edges shaped so that when held together (and meeting where shown by the dotted line) they provide a semi-circular shape groove 1C.

Figure 2:
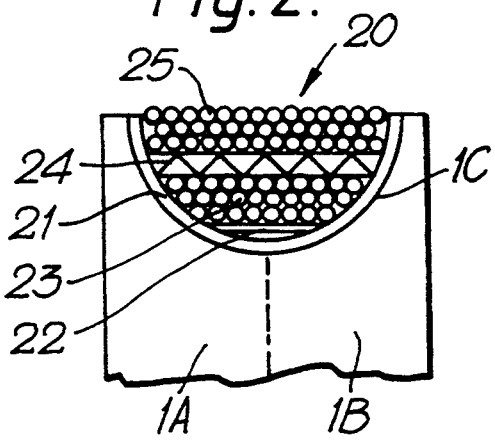
FIG. 2 shows a part elevation of the former of FIG. 1, on enlarged scale, with a coil wound thereon.

FIG. 2 shows the configuration of an electrical coil for a transformer wound in the groove 1C of the former 1A, 1B. The whole groove is first lined with an insulation layer 21 and a flat insulation layer 22 is then positioned at the innermost part of the groove. Electrical conductor is then wound into the groove to form an inner primary winding 23 for the transformer which may have an input primary voltage of 33 KV. A further flat insulation layer 24 is placed on the primary winding 23, and further electrical conductor is then wound into the groove 1C to fill the groove and form an outer secondary winding 25 for the transformer which may have an output secondary voltage of 400 V. The windings 23 and 25, with the insulation layers 21, 22, 24 provide a pre-formed coil 20 from which the former sections 1A and 1B are then removed. The shape of the pre-formed coil 20 can then be consolidated by taping.

Figure 3:
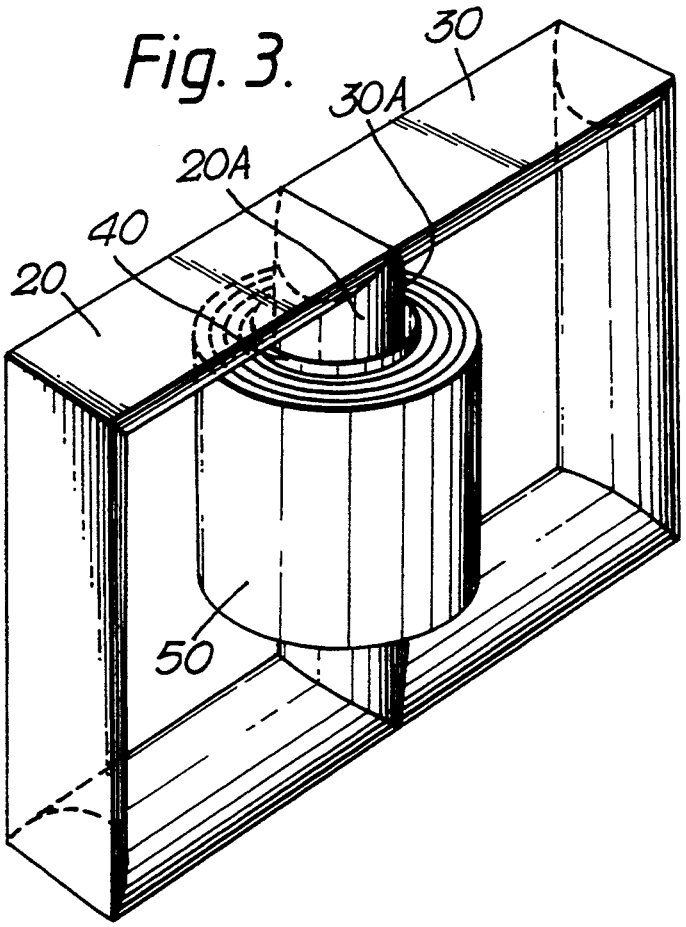
FIG. 3 shows the coil-core configuration of a transformer with two pre-formed coils assembled together, a mandrel around a circular cylinder formed by the coils where they meet, and an incomplete magnetic core formed by winding steel strip on the mandrel.

The pre-formed coil 20 is then assembled together with a similar pre-formed coil 30 as shown in FIG. 3 so that where they meet their semi-circular cross-sectioned parts 20A, 30A combine to form a circular section solid cylinder. A hollow circular mandrel 40 of electrically insulating material, for example epoxy resin, is then formed around the circular cylinder 20A, 30A.

The mandrel 40 is then rotated to wind thereon a roll of continuous non-amorphous conventional grain oriented electrical steel strip to form an uncut, unannealed, wound magnetic core 50 which fills the space within the coils 20, 30. For ease of illustration only an inner part of the core is shown in FIG. 3. The mandrel 40 may be rotated for example by means of gear teeth provided at one end, or by being belt driven at one end, or by a wheel contacting the steel strip. The mandrel 40 is left to remain in the finished transformer. The mandrel 40 located around the coil cylinder 20A, 30A could alternatively be of metal, preferably non-magnetic, with electrical insulation provided between the mandrel and the coil cylinder.

There is thus provided, as shown in FIG. 3, a core-coil configuration having a wound magnetic core 50 with a central window, the core being of overall circular shape and rectangular cross-section formed of non-amorphous steel strip having a single width and two electric coils which are of overall rectangular shape and extend through the core window with the coil cross-sections substantially filling the core window. The primary windings of the two coils 20, 30 may be connected in series with the secondary windings of the two coils connected in parallel to form a single-phase power distribution transformer.

The width of the non-amorphous steel strip from which the core 50 is wound is in the range 250 mm to 1 m and it is of single thickness, although multiple thickness strip could be used. We consider it would be difficult to handle and uneconomic to wind a strip having a width greater than 1 m. This strip width will enable transformers to be made having a power rating in the range 10 KVA to 2000 KVA. A core having this same axial length in the range of 250 mm to 1 m could be made up to four stacked coaxial rolls, for example two rolls each having a strip width of 500 mm.

As discussed in the introductory portion of this patent specification the weight, cost and power loss of the transformer may be reduced by substituting the conventional grain oriented electrical steel strip with a different non-amorphous steel strip having a power of less than 1.00 Watts/Kg at a magnetic induction of 1.7 Tesla at 50 HZ, which may have a thickness between 0.2 mm and 0.1 mm. High permeability, low loss, non-amorphous steel strips of this type known as Hi-B, domain refined Hi-B and 6% Si-Fe are described and discussed, for example, in an article "Modern Transformer Core Materials" by M. R. Daniels published in GEC REVIEW Volume 5, NO. 3, 1990 at pages 132 to 139.

A modification of the method of manufacture described above will enable amorphous steel, which is presently available in smaller strip widths of up to approximately 200 mm, to be used to provide the same configuration of an uncut circular core wound on pre-formed rectangular coils thus further extending the low loss advantage of this configuration. In this modified method the mandrel 40 is located on the circular cylinder 20A, 30A of the pre-formed coils 20,30 as before. A roll of amorphous steel strip is wound on another mandrel having the same external diameter as the mandrel having the same external diameter as the madrel 40, and this roll of amoorphous steel strip is then annealed under magnetic saturation. The mandrel 40 and the other mandrel are then rotated to transfer the annealed amorphous steel strip on to the mandrel 40.

It is essential that the two coils 20, 30 have a semi-circular cross-section at least in their legs where they will pass through the core window. A possible alternative to all four legs of each coil 20, 30 having a semi-circular cross-section would be for the leg opposite the core window to be of rectangular section with the two linking legs providing a transformation from semi-circular to rectangular section.

As discussed in the introductory portion of this patent specification it is most convenient to have two coils 20, 30 extending through the core 50. More than two coils can be provided, each pre-formed on a former having more than two second. Each such former will provide a groove having for where the coil will pass through the coil, the shape of a sector of a circle less than a semi-circle such that when the coils are assembled together these circle sector cross-sectioned parts will combine to form a circular section solid cylinder where they meet. It will be difficult to provide a former having the number of sections required for a coil which will be one of a set of more than four coils assembled together to extend through the core window. Partly for this reason and also because, as metioned in the introductory portion of this patent specification, it may be desirable to impregnate the coils with resin before they are assembled together, we consider the assembly of four coils together to be a practicable upper limit.

The former sections 1A,1B which are held together constitute a support which provides the groove 1C in which the coil conductors are wound. These former sections must be separated for removal of the coil. However, instead of providing former sections which are completely removed after winding the coil, it may be possible to provide a sectioned former assembly which is expanded to separate the sections for removal of the coil while still holding these sections together.

A moulded insulating frame may be provided which is fitted in the sectioned former before winding the coil conductors, and this insulating frame may remain as part of the consolidated coil after its removal from the former. It may be possible that such an insulating frame can itself be the support providing the groove for winding the coil, obviating the need for a sectioned former.

As discussed in the introductory portion of this patent specification, if multi-phase transformation is required it will be possible to provide a number of discrete side-by-side single-phase transformer configurations.

Figure 4:
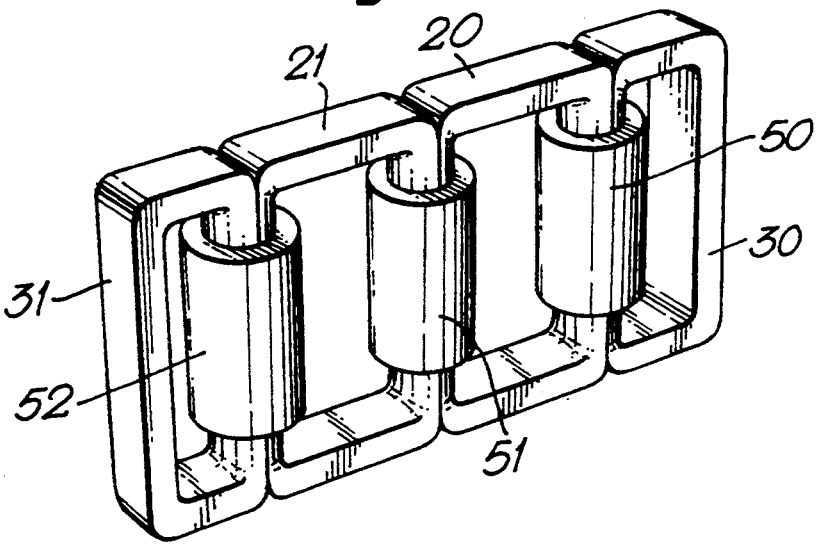
FIG. 4 shows the coil-core configuration of a three-phase transformer having three wound cores and four rectangular coils.

FIG. 4 shows an alternative coil-core configuration for a three-phase transformer. There are three overall circular, rectangular cross-section, wound cores 50,51,52 and four rectangular coils 20,30,21,31. Each core window has two of the coils passing through it and these two coils each have a semi-circular cross-section where they pass through the respective core window.

Figure 5:
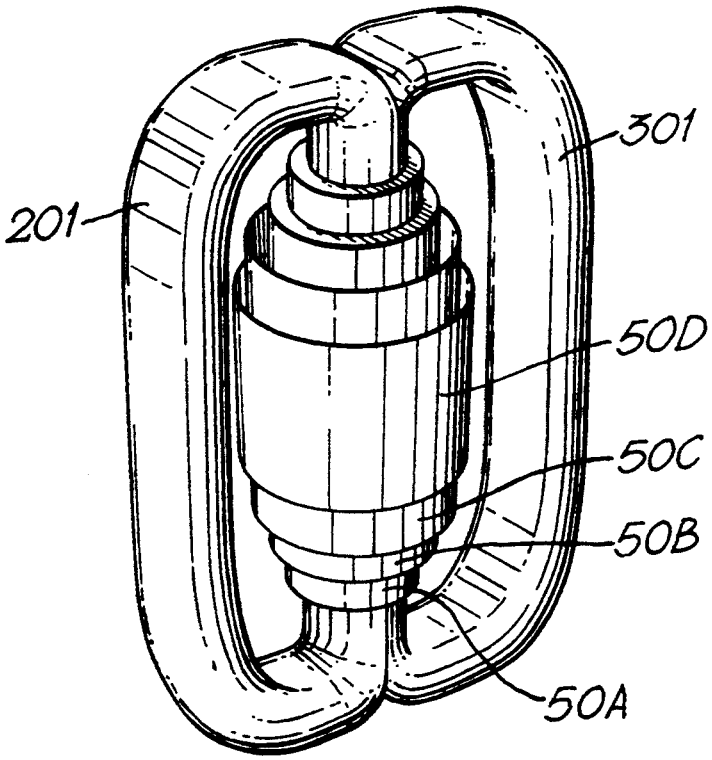
FIG. 5 shows an elliptical configuration of two coils and a wound core of a transformer.

Referring now to FIG. 5, there is shown a coil-core configuration for a transformer which is a modification of the configuration shown in FIG. 3. Instead of overall rectangular shape coils being pre-formed, overall semi-elliptial shape electric coils, two such coils 201, 301 being shown in FIG. 5, are pre-formed. The coils 201, 301 again are combined to form a circular section solid cylinder where they meet. The mandrel (not shown for convenience in FIG. 5) on this cylinder is rotated successively to wind thereon four multiple turn rolls 50A,50B,50C,50D of single width non-amorphous steel strip. Successive rolls 50A–50D are coaxially wound one around another and are of decreasing strip width with the strip width of the radially inner roll 50A being not more than 1 m and the strip width of the radially outer roll being not less than 250 mm. The rolls 50A–50D therby form an unannealed wound magnetic core, having overall circular shape and ellipse segment cross-section, with the core window substantially filled by the coils 201, 301. As mentioned in the introductory part of this specification, coils of this semi-elliptical shape should be less liable to failure in service in short-circuit conditions than the rectangular shape coils as shown in FIG. 3.

In the same manner as for the FIG. 3 configuration we consider that amorphous steel, taking into account that it is presently available in strip widths only up to approximately 200 mm, can be used to provide a coil-core configuration as shown in FIG. 5. The method of forming such a configuration will involve rotating a first further circular cylindrical mandrel having the same external diameter as the first mandrel to wind thereon a first roll of continuous single width amorphous steel strip, rotating at least a second further circular cylindrical mandrel, successive further mandrels having the same external diameter as the previous roll of amorphous steel strip, to wind .each on an individual mandrel at least a second roll of continuous single width amorphous steel strip, the successive rolls being of decreasing strip width, annealing the rolls of amorphous steel strip under magnetic saturation, and rotating the first mandrel and successively the further mandrels to transfer the annealed amorphous steel strip as rolls being coaxially wound one around another and of decreasing strip width on to the first mandrel.

Figure 6:
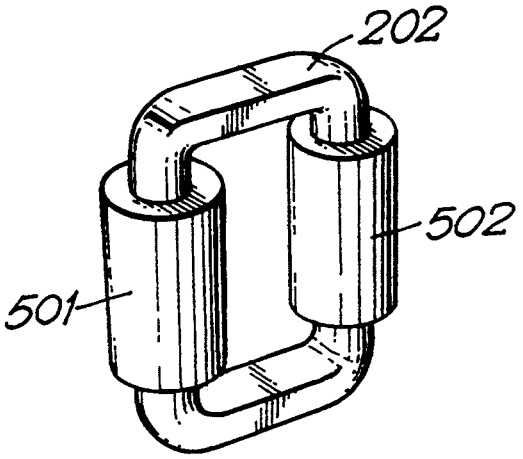
FIG. 6 shows the coil-core configuration of a transformer with a single circular cross-section overall rectangular coil and a wound core on each of two legs of the coil.

Referring now to FIG. 6, there is shown a coil-core configuration for a transformer with a single pre-formed coil 202 having an overall rectangular shape and a circular cross-section. A hollow circular cylindrical mandrel (not shown for convenience in FIG. 6) is located around each of two opposite coil legs, and each mandrel is rotated to wind thereon a single roll of continuous non-amorphous steel strip having a single width in the range 250 mm to 1 m thereby to form an unannealed, uncut wound magnetic core 501, 502 on each mandrel, having overall circular shape and rectangular cross-section, with the windows of each said core substantially filled by the coil.

Compared with having a transformer with coils passing through a single core, as previously described with reference to FIG. 3, the two cores 501, 502 of the arrangement shown in FIG. 6 may have a smaller radius in order to provide the total amount of flux carrying core required and hence the mean path length and resulting volume and weight of core steel is reduced. The cores 501, 502 may be considered as a single core wound in two parts.

Figure 7:
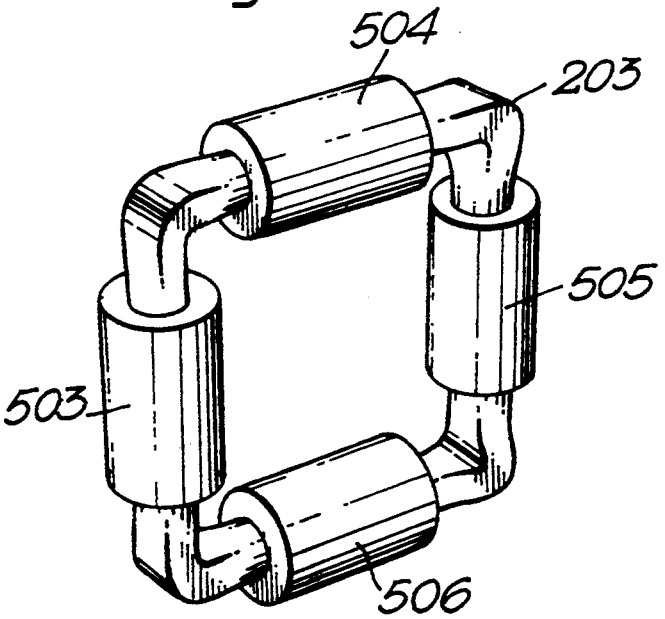
FIG. 7 shows the coil-core configuration of a transformer with a single circular cross-section overall rectangular coil and a wound core on each of the four legs of the coil.

FIG. 7 shows a modification of the FIG. 6 arrangement in which the weight of core steel required may be still further reduced by winding the core in four parts. Thus a single circular cross-section overall rectangular coil 203 has an unannealed, uncut core 503, 504, 505, 506 of overall circular shape and rectangular cross-section wound with non-amorphous steel strip on each of its four legs.

In the same manner as for the FIG. 3 configuration we consider that amorphous steel, taking into account that it is presently available in strip widths only up to approximately 200 mm, can be used to provide a coil-core configuration as shown in FIG. 6 or FIG. 7. The method of forming such a configuration will involve locating a hollow first circular cylindrical mandrel around each of at least two of the circular cross-section coil legs, rotating at least one second circular cylindrical mandrel in respect of each first mandrel having the same external diameter as the respective first mandrel to wind thereon a roll of continuous single width amorphous steel strip, annealing each roll of amorphous steel strip under magnetic saturation, and rotating the first mandrel and the respective second mandrels to transfer the annealed amorphous steel strip on to each of the first mandrels to form on each first mandrel an uncut wound magnetic core having overall circular shape and rectangular cross-section, with the window of each said core substantially filled by said coil.

We claim:

1. An electrical power distribution transformer, comprising: a core and coil assembly having a wound magnetic core with a central window and electric coils which extend through said core window, said core being unannealed, uncut and of overall circular shape and rectangular cross-section, said core constituting a single roll wound of continuous non-amorphous steel strip, said strip constituting at least a single thickness of steel and having a single width in a range from 250 mm to 1 m, and wherein there are a number of said electric coils in a range between two and four, each said coil being of overall rectangular shape, and each said coil having a cross-section which is a sector of a circle at least where said coils pass through the core window with the sector cross-sections together substantially filling the core window.

2. A transformer as claimed in claim 1, in which the non-amorphous steel strip has a thickness between 0.2 mm and 0.1 mm.

3. A transformer as claimed in claim 1, in which the steel strip forming the wound magnetic core is of a single thickness.

4. A transformer as claimed in claim 1, in which the transformer is single-phase with all said coils extending through only one said core.

5. A transformer as claimed in claim 4, in which the transformer has two said electric coils each having a semi-circular cross-section where the coils pass through the core window.

6. An electrical power distribution transformer, comprising: a core and coil assembly having a wound magnetic core with a central window and electric coils which extend through said core window, said core being unannealed, uncut and of overall circular shape and rectangular cross-section, said core constituting stacked co-axial rolls, the number of rolls being in a range from two to four and each roll being wound of continuous non-amorphous steel strip, said strip constituting at least a single thickness of steel and having a single width in a range from 250 mm to 500 mm, and the co-axial rolls having a total axial length in a range from 500 mm to 1 m, and wherein there are a number of said electric coils in a range between two and four, each said coil being of overall rectangular shape, and each said coil having a cross-section which is a sector of a circle at least where said coils pass through the core window with the sector cross-sections together substantially filling the core window.

7. A transformer as claimed in claim 6, in which the non-amorphous steel strip has a thickness between 0.2 mm and 0.1 mm.

8. A transformer as claimed in claim 6, in which the steel strip forming the wound magnetic core is of a single thickness.

9. A transformer as claimed in claim 6, in which the transformer is single-phase with all said coils extending through only one said core.

10. A transformer as claimed in claim 9, in which the transformer has two said electric coils each having a semi-circular cross-section where the coils pass through the core window.

* * * * *